United States Patent [19]

Weidler

[11] 4,114,975

[45] Sep. 19, 1978

[54] DISPLATION TYPE ELECTRICAL CONNECTOR

[75] Inventor: Charles Harry Weidler, Lancaster, Pa.

[73] Assignee: AMP Incorporated, Harrisburg, Pa.

[21] Appl. No.: 817,406

[22] Filed: Jul. 20, 1977

[51] Int. Cl.[2] ..... H01R 13/50

[52] U.S. Cl. ..... 339/176 M; 339/96

[58] Field of Search ..... 339/176 M, 176 R, 151 M, 339/148, 95 D, 95 R, 96, 97 R, 97 C

[56] References Cited

U.S. PATENT DOCUMENTS 3,688,243 8/1972 Yamada et al. ..... 339/176 M X

*Primary Examiner*—Roy Lake
*Assistant Examiner*—DeWalden W. Jones
*Attorney, Agent, or Firm*—Frederick W. Raring

[57] ABSTRACT

Electrical connector comprises an insulating housing having a wire-receiving face into which a cavity extends. A sheet metal terminal is disposed in the cavity and has a displation type wire connecting portion adjacent to the wire-receiving face. The wire connecting portion comprises an elongated metal strip which has been reversely curled inwardly to form a cylindrical surface adjacent to the face and a free end which is spaced from an intermediate portion of the terminal. A wire-receiving slot extends into the strip at the free end and a wire-receiving opening is provided in the curled strip adjacent to the wire-receiving face. In use, a wire is inserted axially through the opening so that the end of the wire is located between the free end of the strip and the intermediate portion of the terminal. The wire connecting portion is then subjected to a force applied against the cylindrical portion of the terminal which causes the wire connecting portion to be further curled. Such curling causes the free end to move past the wire so that the slot receives the wire and establishes electrical contact therewith.

9 Claims, 7 Drawing Figures

DISPLATION TYPE ELECTRICAL CONNECTOR

BACKGROUND OF THE INVENTION

This invention relates to pre-loaded electrical connectors having contact terminals therein which can be connected to wires by displation type electrical connections. The term "pre-loaded", when used with reference to an electrical connector, denotes the fact that the connector contains the terminals as supplied to the user and the user connects the wires to these pre-loaded terminals. The term "displation connection" has been coined to identify that type of electrical connection between a wire and a terminal which is made by moving the wire into a wire-receiving slot provided in the terminal so that edge portions of the slot establish electrical contact with the wire.

Electrical connectors having displation type contact terminals therein are now widely used in the electrical industry; see, for example, U.S. Pat. Nos. 3,012,219, 3,576,518, and 3,820,055. In all of the presently known displation type electrical connecting devices, the wire is connected to the terminal by moving the wire laterally of its axis and into the wire-receiving slot of the terminal. As a result of this limitation, it is a requirement of connectors of this type that the housing having an opening therein which is adjacent to one side of each terminal as well as at the end of each terminal; the wire must move laterally through an opening in the side of the connector housing into the slot of the terminal and after the wire has been moved into the slot of the terminal, it extends axially through the opening in the wire-receiving face of the housing. Such side openings in the side of the housings are not required in other types of electrical connectors such as the type which are designed to receive terminals which have been crimped onto wires. Crimp type terminals are assembled to a housing by merely inserting the terminal into a cavity which extends into the wire-receiving face of the housing.

This requirement of having an opening in a side surface of the housing for each displation type terminal in the connector has the affect of limiting, to some extent, the circumstances under which displation type terminals can be used in electrical connectors. For example, it is impossible to use displation type terminals in a cylindrical electrical connector having some of its contacts spaced from the cylindrical surface of the connector housing for the reason that the inner cavities which are separated from the cylindrical surface of the housing are not accessible and wires can not be moved laterally of their axis into these centrally located cavities. It is also apparent that a three row connector can not be provided with displation type terminals for the reason that the wires can not be moved laterally into the terminals in the center row. Two row connectors can be provided with displation type terminals if the terminals are oriented with their wire-receiving portions in each row facing outwardly, see the U.S. Pat. No. to Roberts 3,760,335. Finally, it should be mentioned that the existence of the side openings in the housing is undesirable under many circumstances because of the loss of dielectric characteristics and the possibility of foreign matter coming into contact with the terminals.

The instant invention is specifically directed to the achievement of a displation type terminal which is capable of receiving a wire upon axial movement, rather than lateral movement, of the wire into the terminal and to the achievement of electrical connectors having such terminals pre-loaded therein.

It is accordingly an object of the invention to provide an improved electrical connector containing displation type electrical terminals. A further object is to provide an electrical connector which is pre-loaded with displation type terminals capable of receiving a wire upon movement of the wire axially into the terminal. A further object is to provide multi-row and cylindrical electrical connectors containing displation type terminals.

These and other objects of the invention are achieved in preferred embodiments thereof which are briefly described in the foregoing abstract, which are described in detail below, and which are shown in the accompanying drawing in which:

FIG. 1 is a perspective view of a two position connector in accordance with the invention having one of the displation type terminals exploded from its cavity.

FIGS. 2 and 3 are cross sectional and end views of the connector housing taken along the lines 2—2 of FIG. 3 and 3—3 of FIG. 2 respectively.

Figure 1:
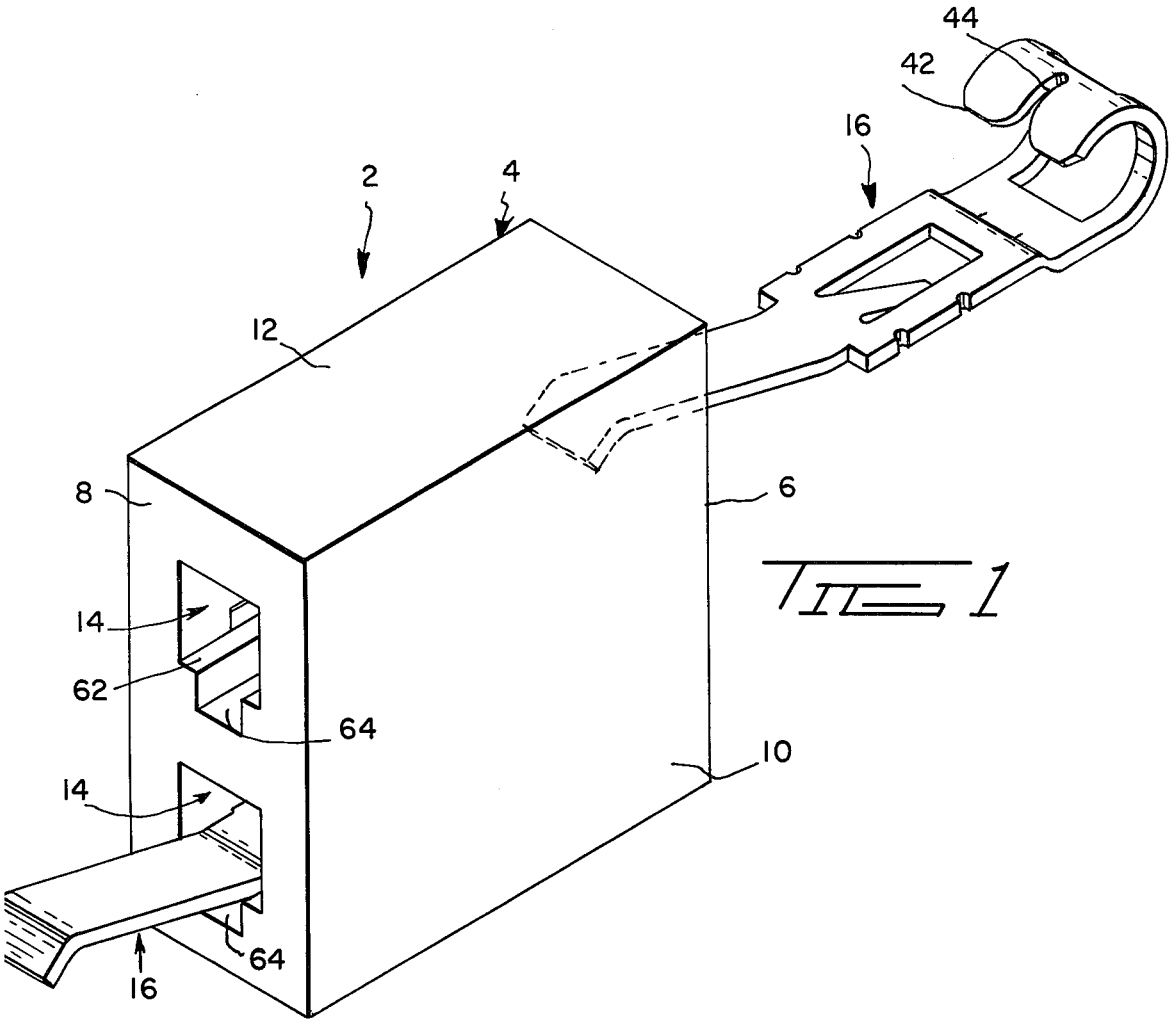
Figure 2:
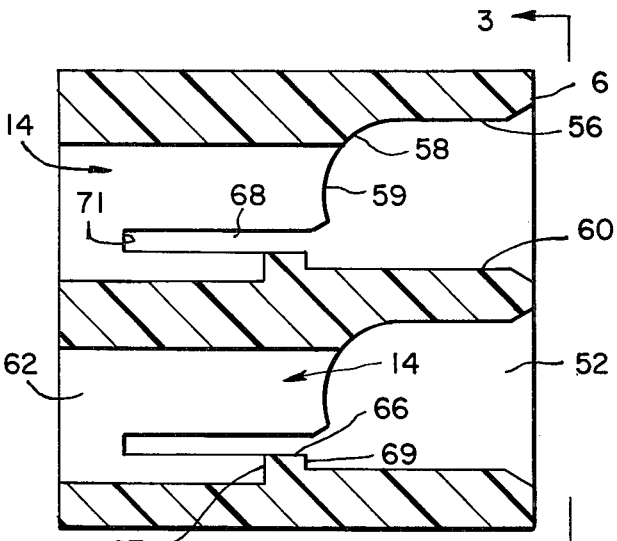
Figure 3:
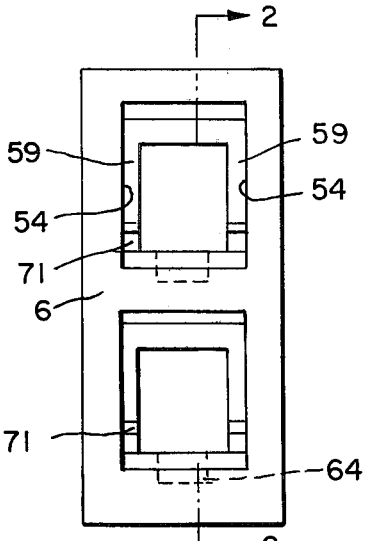

FIGS. 1–4 show an embodiment of the invention comprising a relatively simple two position electrical connector 2 comprising a prismatic insulating housing 4 having a wire-receiving face 6, a mating face 8, and laterally facing side and end surfaces 10, 12. Two contact receiving cavities 14 extend through the housing from the face 6 to the face 8, these cavities being disposed one above the other as viewed in FIGS. 2 and 3. Each cavity contains a contact terminal 16 and these terminals will be described in detail prior to the presentation of a detailed description of the cavities.

Figure 5:
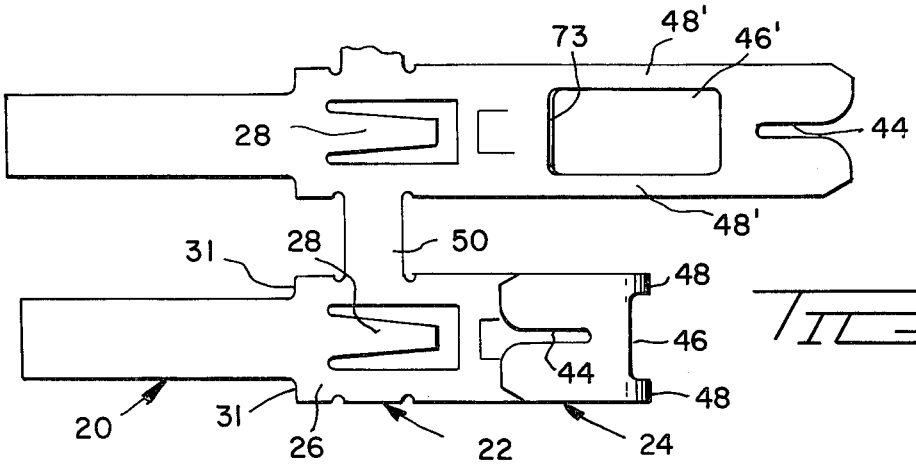
FIG. 5 is a plan view of a short section of terminal strip showing the flat blank from which the terminal is formed and also showing a completely formed terminal.

The terminals 16 are manufactured as a continuous strip 18 (FIG. 5) with adjacent terminals in the strip being connected by integral connecting necks 50. Each terminal has a contact portion 20 at its forward or mating end, an intermediate portion 22, and a wire-receiving portion 24 at its rearward end. The intermediate portion 22 comprises a generally flat rectangular section 26 of sheet metal having a downwardly, as viewed in the drawing, extending lance 28 integral therewith which functions to retain the terminal in the housing. The contact portion 20 of the terminal shown comprises a contact spring which extends obliquely from the flat section 26 and which is reversely bent as shown at 32 and extends from the bend to the tip 34. The spring 30 is slightly more narrow than the intermediate section 26 so that leftwardly directed shoulders 31, as viewed in FIG. 5, are provided which serve as stops as described below. The spring 30 is particularly intended to establish contact with a terminal post or a similar device but it will be understood that other types of contact portions can be provided.

The wire-connecting portion 24 comprises relatively short flat section 38 which is connected to the intermediate portion 23 by an offset 36 and a stop 37 is struck from this offset for purposes which will be discussed below. The wire connecting portion extends from the flat base 38 arcuately upwardly as shown at 40 and then downwardly to a free end 42. It will be apparent from FIG. 5 that this cylindrical portion 40 of the wire-receiving portion of the terminal is produced by curling a flat blank through an angle of substantially 260°, the radius of curvature of this cylindrical portion being such that the free end is disposed above, and in alignment with, the offset 36. An opening 46' is stamped in the blank of FIG. 5 so that the free end is connected to the offset 36 by two relatively narrow straps 48' of the blank and after curling, a wire-receiving opening 46 is thus provided in the right hand portion of the terminal. The free end 42 has a wire-receiving slot 44 extending inwardly therefrom, the width of this slot being such that upon relative movement of the wire 72 into the slot 44, the insulation of the wire will be displaced and the edges of the slot will establish electrical contact with the conducting core of the wire.

Each of the cavities 14 comprises a relatively enlarged pocket 52 which extends inwardly from the wire-receiving face 6 and a generally rectangular portion 62 which extends inwardly from the mating face 8 and intersects the pocket intermediate the ends of the cavity. The pocket portion 52 has parallel sidewalls 54, a top wall 56, and a floor 60. The top wall 56 merges at its inner end with cylindrical wall portions 58 and these cylindrical portions extend to, and define, the intersection between the pocket and the frontal portion 62 of the cavity. There are thus provided two relatively narrow downwardly directed cylindrical surface portions 59 which, as will be explained below, provide a bearing surface for the parallel spaced-apart connecting straps 48 of the terminal. An upwardly extending lip or barrier 66 is provided at the inner end of the floor 60 of the cavity portion and this barrier provides oppositely directed shoulders 67, 69 which cooperate with the lance 28 and the stop 37 of the terminal to prevent movement of the terminal in either direction after insertion. It should also be noted that relatively shallow grooves 68 are provided on the sidewalls of the frontal portion 62 to receive the intermediate flat portion 26 of the terminal. The shoulders 31 move against the ends of these grooves as shown at 71 in FIG. 4.

It will be apparent that the terminals are inserted into the cavities by merely properly orienting the terminals and moving them through the cavities to the wire-receiving face 6 towards the mating face 8. After insertion has been completed, the stops 28, 37 will hold the terminals in their proper locations. A groove 64 is provided in the floor of the frontal portion 62 of each cavity 14 to permit entry of an extraction tool. When a terminal must be extracted, the tool is moved against the lance 28 and the lance is deflected thereby to permit removal of the terminal.

Figure 4:
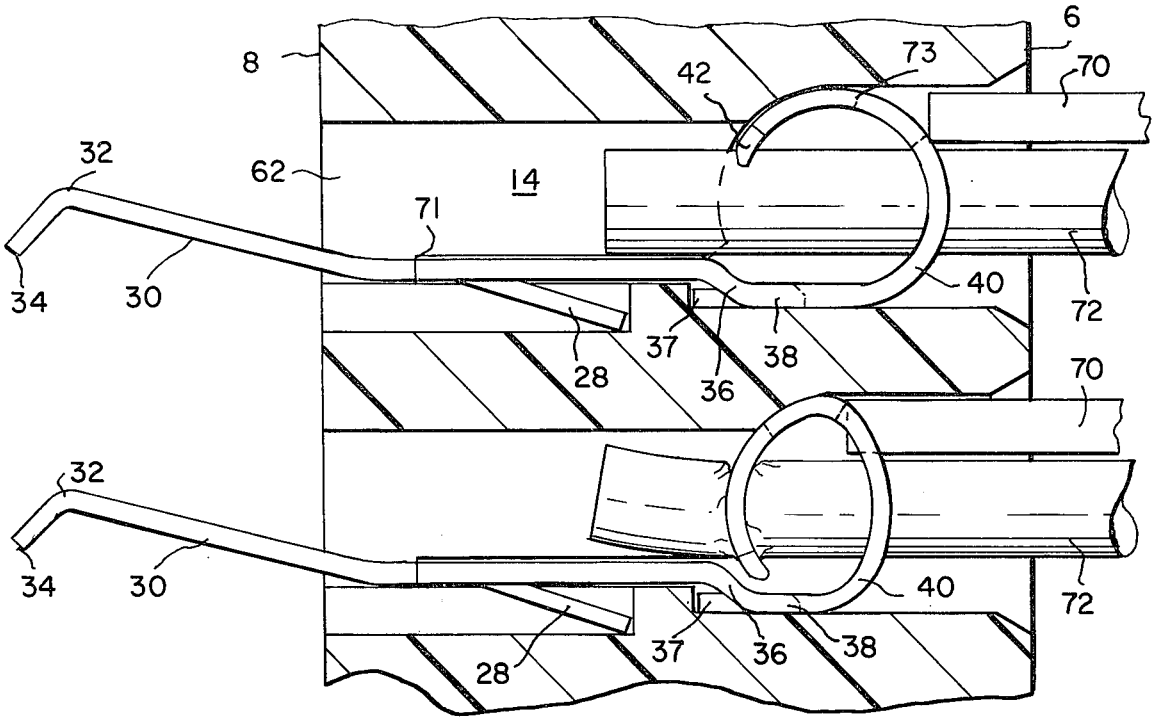
FIG. 4 is a view similar to FIG. 2 but showing terminals in the contact receiving cavities of the housing, one of these terminals being shown as applied to the end portion of a wire.

As shown in FIG. 4, the wire-receiving portions of the terminals are dimensioned such that they fit relatively snugly in the pocket portions 52 of the cavities with the straps 48 and the arcuate or cylindrical surface 40 disposed against the surface portions 58, 59 of the cavities. The wire-receiving opening 46 of each terminal will then be immediately adjacent to the wire-receiving face 6 of the housing and the free end 42 of the terminal will be spaced from the offset 36 thereof.

When a wire 72 is to be connected to one of the terminals 16 in the housing, the wire is merely aligned with the wire-receiving opening 36 and inserted through this opening until the wire extends beyond the free end 42 of the terminals as shown in FIG. 4. Thereafter, a suitable terminating tool 70 is positioned against the edge 73 of opening 46 of the terminal and an inward force is applied against the edge 73. The application of this force to the terminal causes further curling of the wire connecting portion so that the free end 42 moves along an arcuate path which extends past the axis of the previously inserted wire. During such movement, the wire-receiving slot 44 receives the wire 72 which remains substantially stationary and the edges of the slot penetrate the insulation of the wire and establish electrical contact with the conducting core thereof. It will be noted that although the wire remains stationary, the relative movement of the terminal with respect to the wire is substantially the same as if the wire were to move laterally of its axis and to the wire-receiving slot.

In the explanation presented above, it is stated that the electrical connection is achieved by curling the wire connecting portion of the terminal. Such curling may be accompanied by partial flattening of the wire-receiving portion as indicated in FIG. 4 so that the final shape of the terminal may be that of an oval with a substantially flat base. The precise form of a terminal after the termination has been made will depend upon several factors such as the spring characteristics and thickness of the metal and the manner in which the force is applied thereto. However, some curling affect will take place in order to cause the movement of the free end portion of the terminal past the wire. Other flattening or compressing techniques might also be used to achieve movement of the free end portion of the terminal past the wire in response to the application of a force parallel to the wire.

Some care must be taken in the selection of the metal stock from which the terminal strip is manufactured if the curling effect shown in FIG. 4 is to be achieved. In general, a spring hard material should be used since a spring material will tend to curl upon application of the force against the edge 73. A spring material is required for the displation type electrical connection between the wire and the slot 42 in the free end of the terminal. A suitable spring material, for example, is a 6 hard phosphour bronze or a suitable brass composition. The force required to bring about the curling operation can also be controlled to some extent by changing the dimensions of the opening 46' in the blank shown in FIG. 5. Reducing the width of the straps 48' will result in a reduction of the force required to bring about the curling operation.

Under some circumstances, the wire connecting portion of the terminal may spring back slightly after the deforming tool 70 is removed from the cavity but any spring back of this type will not disturb the electrical connection since the spring back will occur at locations remote from the end portion of the terminal such as at the base of the terminal as viewed in FIG. 4.

Figure 6:
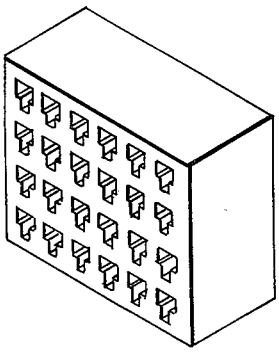
FIGS. 6 and 7 are perspective views of a multi-row rectangular connector and a cylindrical connector respectively.
Figure 7:
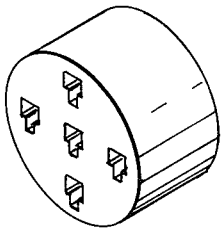

A salient advantage of the invention is that the wire is moved axially into the terminal rather than laterally of its axis into the terminal and the force which causes the terminal to be connected to the wire is also applied parallel to the axis of the wire. As a result, the cavities can be entirely surrounded or enclosed and there is no requirement as with prior art displation connectors that the cavities be accessible from a side surface of the housing. By virtue of this feature, multi-row end connectors and cylindrical electrical connectors as shown in FIGS. 6 and 7 can be provided with displation type terminals.

What is claimed is:

1. A pre-loaded electrical connector comprising:

an insulating housing having a wire-receiving face and having a contact receiving cavity extending into said wire-receiving face, a sheet metal contact terminal in said cavity, said terminal having a wire connecting portion which is proximate to said wire-receiving face, said wire connecting portion comprising an elongated metal strip having a reversely formed portion in said cavity and having a wire-receiving opening therein which is adjacent to said wire-receiving face, said strip having a free end which is generally opposite to said wire-receiving opening, said free end being spaced from an intermediate portion of said terminal, a wire-receiving slot extending inwardly from said free end through portions of said strip, said wire connecting portion being deformable inwardly of said cavity with concomitant movement of said free end past an inserted wire and transversely of the axis of an inserted wire whereby, upon insertion of a wire through said wire-receiving opening and into said cavity so that an end portion of said wire is between said free end of said terminal and said intermediate portion of said terminal, and upon applying a deforming force to said wire connecting portion of said terminal, said free end of said strip moves past said end portion of said wire and said slot receives said wire whereby edge portions of said slot establish electrical contact with said wire.

2. A pre-loaded electrical connector as set forth in claim 1, said connector housing having a plurality of said contact terminal receiving cavities extending into said wire-receiving face, all of said cavities being entirely surrounded by portions of said housing.

3. A pre-loaded electrical connector as set forth in claim 2, said cavities being arranged in at least two parallel rows.

4. A pre-loaded electrical connector as set forth in claim 2, said housing being cylindrical.

5. A pre-loaded electrical connector as set forth in claim 1, said reversely formed portions of said metal strip being cylindrical.

6. A pre-loaded electrical connector as set forth in claim 1, said wire connecting portion being reversely formed by curling into a cylindrical portion which extends arcuately to said free end, said cavity having a cylindrical surface which substantially conforms to said cylindrical portion of said terminal, said wire connecting portion being deformable by further curling of said cylindrical portion to reduce the radius thereof and cause said free end to move past said inserted wire.

7. A pre-loaded electrical connector comprising:

an insulating housing having a mating face and a wire-receiving face, a contact cavity extending through said housing from said mating face to said wire-receiving face, a stamped and formed electrical contact terminal in said cavity, said terminal having a wire connecting portion which is proximate to said wire-receiving face, a mating portion which is proximate to said mating face, and a transition portion between said wire connecting portion and said mating portion, said wire connecting portion comprising a reversely formed sheet metal strip having a cylindrical surface which is adjacent to said wire-receiving face and having a free end, a slot extending inwardly from said free end, and a wire-receiving opening in said cylindrical surface at a location opposite to said free end, said cavity having a pocket portion at said wire-receiving face in which said wire-receiving portion is disposed, said pocket having a cylindrical surface which substantially conforms to said cylindrical surface of said wire connecting portion whereby, upon insertion of a wire into said pocket, through said opening and past said free end, and upon further curling of said cylindrical wire-receiving portion, said free end moves past said wire and said slot receives said wire whereby edge portions of said slot establish electrical contact with said wire.

8. An electrical connector installed on the ends of a plurality of wires:

said connector comprising an insulating housing having a wire-receiving face and having a plurality of contact receiving cavities extending into said wire-receiving face, a sheet metal contact terminal in each of said cavities, each of said terminals having a wire connecting portion which is proximate to said wire-receiving face, said wire connecting portion of each terminal comprising an elongated spring metal strip having a reversely formed portion in said cavity and having a wire-receiving opening therein which is adjacent to said wire-receiving face, said wire connecting portion extending arcuately from said opening inwardly of said cavity to a free end portion, said free end portion being generally opposite to said wire-receiving opening, said free end portion having a wire-receiving slot extending therein, each of said wires extending into one of said cavities, through the wire-receiving opening in the terminal in said one cavity and being held in the wire-receiving slot of said terminal, edge portions of each of said slots being in electrical contact with the conducting cores of each of said wires.

9. A connector installed on a plurality of wire as set forth in claim 8, each of said terminals being, with respect to its respective cavity, deformed.

* * * * *